US007980732B2

(12) United States Patent
Kawamura

(10) Patent No.: US 7,980,732 B2
(45) Date of Patent: Jul. 19, 2011

(54) PROJECTOR TYPE LAMP

(75) Inventor: Takayuki Kawamura, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 176 days.

(21) Appl. No.: 12/043,492

(22) Filed: Mar. 6, 2008

(65) Prior Publication Data

US 2008/0219009 A1 Sep. 11, 2008

(30) Foreign Application Priority Data

Mar. 8, 2007 (JP) ..... 2007-059017

(51) Int. Cl.
*F21V 7/00* (2006.01)

(52) U.S. Cl. ..... 362/308; 362/507; 362/549

(58) Field of Classification Search ..... 362/308, 362/507, 549
See application file for complete search history.

(56) References Cited

U.S. PATENT DOCUMENTS

| | | | | |
|---|---|---|---|---|
| 5,177,641 | A | 1/1993 | Kobayashi et al. | |
| 5,926,326 | A * | 7/1999 | Fischer et al. | 359/819 |
| 7,134,774 | B2 | 11/2006 | Iwasaki | |
| 7,144,145 | B2 | 12/2006 | Watanabe et al. | |
| 7,258,466 | B2 | 8/2007 | Watanabe et al. | |
| 2004/0027834 | A1 * | 2/2004 | Chigusa et al. | 362/511 |
| 2004/0032744 | A1 | 2/2004 | Nishizawa et al. | |
| 2005/0180156 | A1 * | 8/2005 | Iwasaki | 362/538 |

FOREIGN PATENT DOCUMENTS

| | | | |
|---|---|---|---|
| EP | 0 750 157 | A2 | 12/1996 |
| EP | 1 647 764 | A2 | 4/2006 |
| FR | 1 269 171 | | 8/1961 |
| FR | 2 863 343 | A1 | 6/2005 |
| FR | 2 865 524 | A1 | 7/2005 |
| JP | 2005-235419 | A | 9/2005 |

OTHER PUBLICATIONS

English Translation of EP 0750157.*

* cited by examiner

*Primary Examiner* — Evan Dzierzynski
(74) *Attorney, Agent, or Firm* — Foley & Lardner LLP

(57) ABSTRACT

An projector type lamp includes a casing formed with a front open end and configured by connecting an upper casing member and a lower casing member to each other; a concave mirror formed on an inside face of the casing; a light source provided at the first focal point of the concave mirror; a convex lens configured to be held between the upper casing member and the lower casing member at the front open end of the casing and adapted to refract a reflected light that is emitted from the light source and reflected on the concave mirror so as to project a substantially parallel pencil beam forward from the project type lamp; provisional fixers provided on the upper casing member and the lower casing member respectively and configured to latch one another so as to provisionally fix the casing members to one another in place; and a fastener configured to fasten the provisionally-fixed casing members together.

5 Claims, 8 Drawing Sheets

PROJECTOR TYPE LAMP

CROSS REFERENCE TO RELATED APPLICATIONS AND INCORPORATION BY REFERENCE

This application is based upon and claims the benefit of priority from the prior Japanese Patent Application No. 2007-059017 filed on Mar. 8, 2007, the entire contents of which are incorporated herein by reference.

BACKGROUND OF THE INVENTION

1. Field of the Invention

The present invention relates to a projector type lamp that can be used in a vehicular head-lamp.

2. Description of the Related Art

Japanese Patent Application Laid-Open No. 2005-235419 discloses a projector type lamp. The projector type lamp includes: a casing formed with a front open end; a concave mirror formed on an inside face of the casing; a light source provided at or around the first focal point of the concave mirror; and a convex lens fitted in the front open end of the casing and configured to refract a reflected light that is emitted from the light source and reflected on the concave mirror so as to project a substantially parallel pencil beam forward from the project type lamp.

The casing is formed by connecting an upper casing member and a lower casing member together and fastening the casing members by screws.

SUMMARY OF THE INVENTION

In the conventional art, the casing members are coupled together and fastened by screws so that the convex lens is fixedly supported between the casing members. When fastening the casing members by screws to assemble the projector type lamp, assembly workers have to grasp the casing members tightly to prevent the convex lens from falling off the casing members. This makes the assembly of the projector type lamp difficult.

An aspect of the present invention provides a projector type lamp. The projector type lamp comprises a casing formed with a front open end, the casing formed by connecting an upper casing member and a lower casing member; a concave mirror formed on an inside face of the casing; a light source provided at or around the first focal point of the concave mirror; a convex lens configured to be held between the upper casing member and the lower casing member at the front open end of the casing and adapted to refract a reflected light that is emitted from the light source and reflected on the concave mirror so as to project a substantially parallel pencil beam forward from the project type lamp; provisional fixing members formed at the upper casing member and the lower casing member respectively and configured to latch one another so as to provisionally fix the casing members to one another; and a fastener configured to fasten the provisionally-fixed casing members together.

DETAILED DESCRIPTION OF THE INVENTION

Embodiments according to the present invention will be described with reference to the drawings.

First Embodiment

A projector type lamp of a first embodiment will be described with reference to FIGS. 1 to 10

Figure 1:
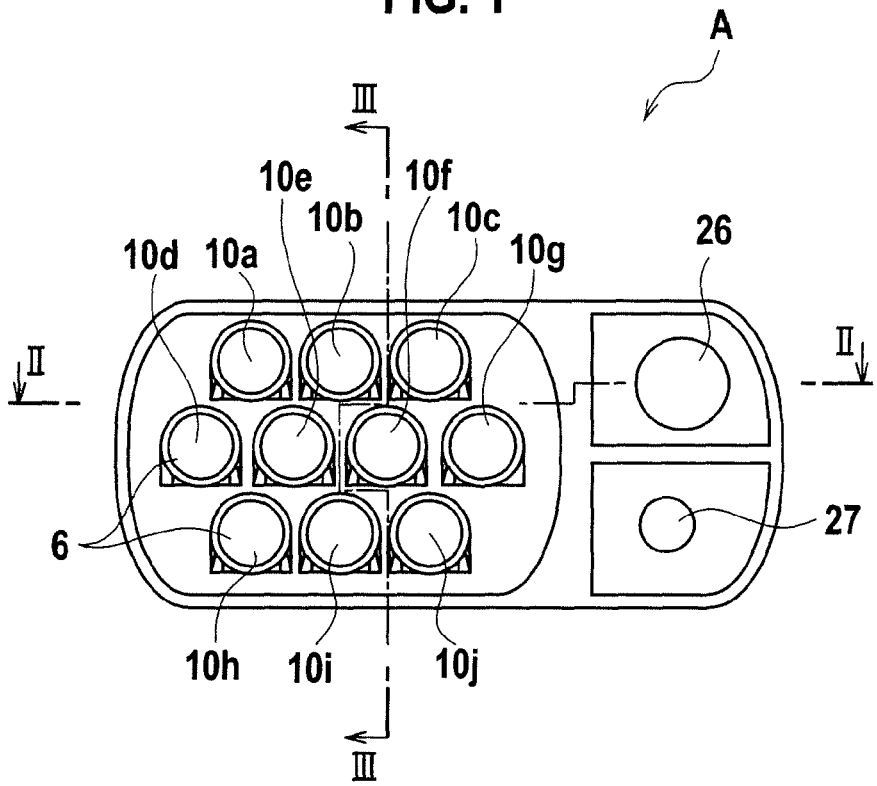
FIG. 1 is a front view of a vehicular head lamp incorporating a projector type lamp of a first embodiment of the present invention.
Figure 2:
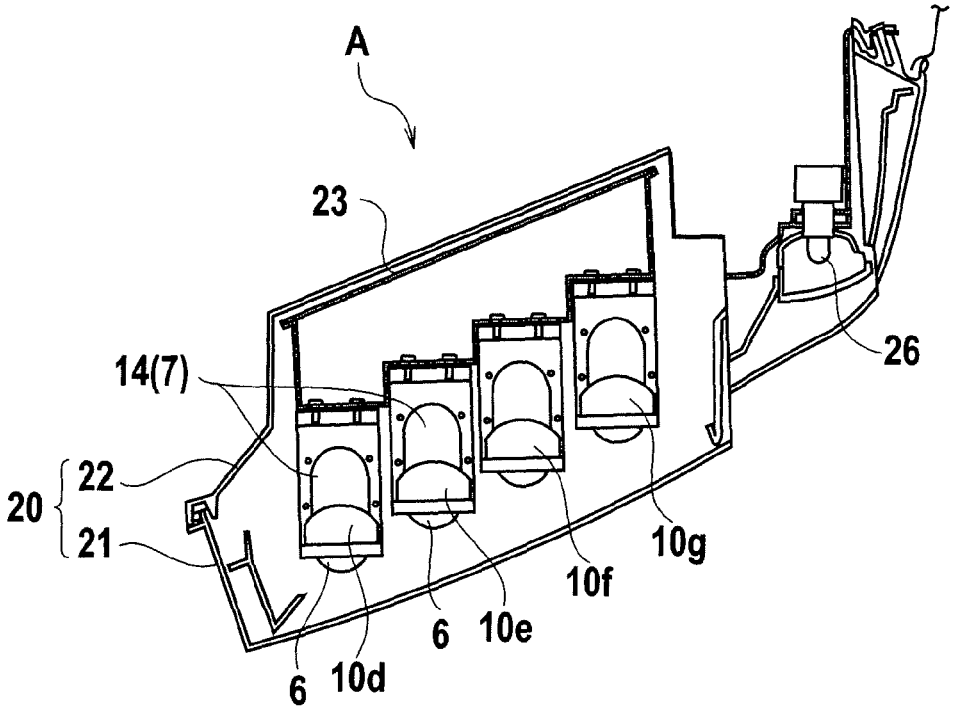
FIG. 2 is a cross section of the vehicular head lamp taken along a line II-II in FIG. 1.
Figure 3:
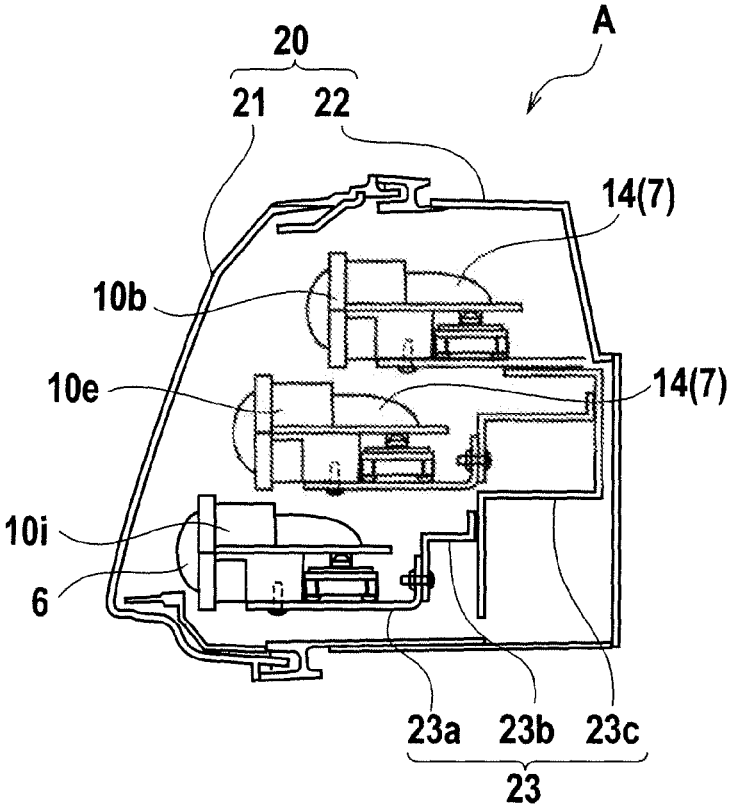
FIG. 3 is a cross section of the vehicular head lamp taken along a line III-III in FIG. 1.

FIGS. 1 to 3 show a vehicular head lamp A incorporating the projector type lamp of the present embodiment. The head lamp A includes a plurality of projector type lamps 10*a*, 10*b*, 10*c*, 10*d*, 10*e*, 10*f*, 10*g*, 10*h*, 10*i*, 10*j* incorporated into a housing 20. The housing 20 includes a substantially box-shaped housing body 22 that is formed with a front open end, and an outer lens 21 that covers the front open end of the housing body 22. The single housing 20 accommodates the projector type lamps 10*a* to 10*j*. The projector type lamps 10*a* to 10*j* are mounted to the housing body 22 by mounting bracket 23 including a first mounting bracket 23*a*, a second mounting bracket 23*b*, and a third mounting bracket 23*c*, so that substantially hemispherical-shaped convex projection lenses 6 of the projector type lamps 10*a* to 10*j* face the outer lens 21. The mounting bracket 23 is vertically and horizontally pivoted to the housing body 22 by means of a pivot structure (not shown) and two adjustor screws, such that the optical axes of the projector type lamps 10*a* to 10*j* are vertically and horizontally inclinable integrally.

In FIGS. 1 and 2, the numeral 26 represents a front position lamp and the numeral 27 represents a front turn signal lamp.

Next, the configuration of the projector type lamps 10*a* to 10*j* will be explained in detail with reference to FIGS. 4 to 10. The configurations of the projector type lamps 10*a* to 10*j* are substantially the same, so they are referred to as a projector lamp 10 in the following description.

Figure 4:
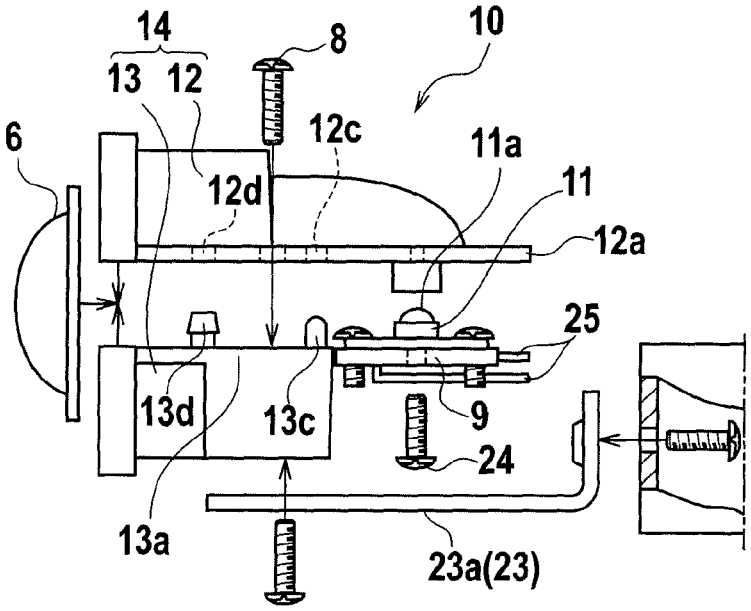
FIG. 4 is an exploded side view of the projector type lamp of the first embodiment.
Figure 5:
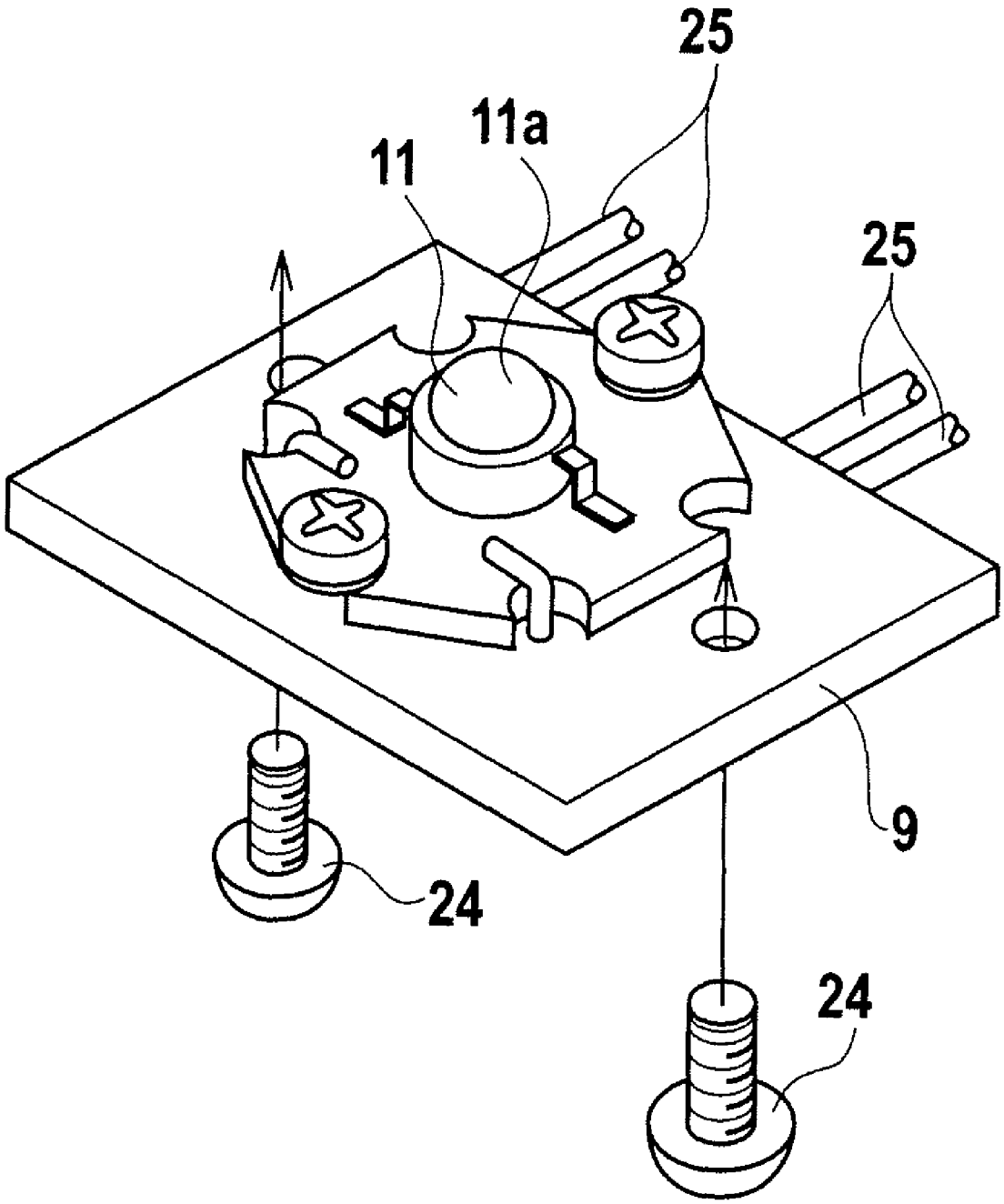
FIG. 5 is a perspective view of the projector type lamp of FIG. 4, in which an LED is mounted.
Figure 6:
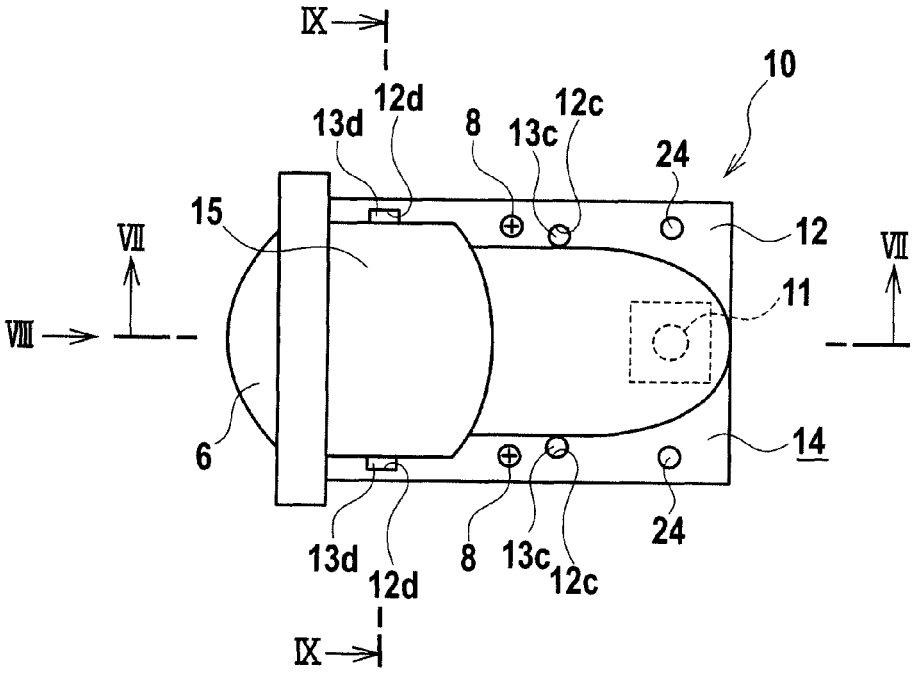
FIG. 6 is a plane view of the projector type lamp of the first embodiment.
Figure 7:
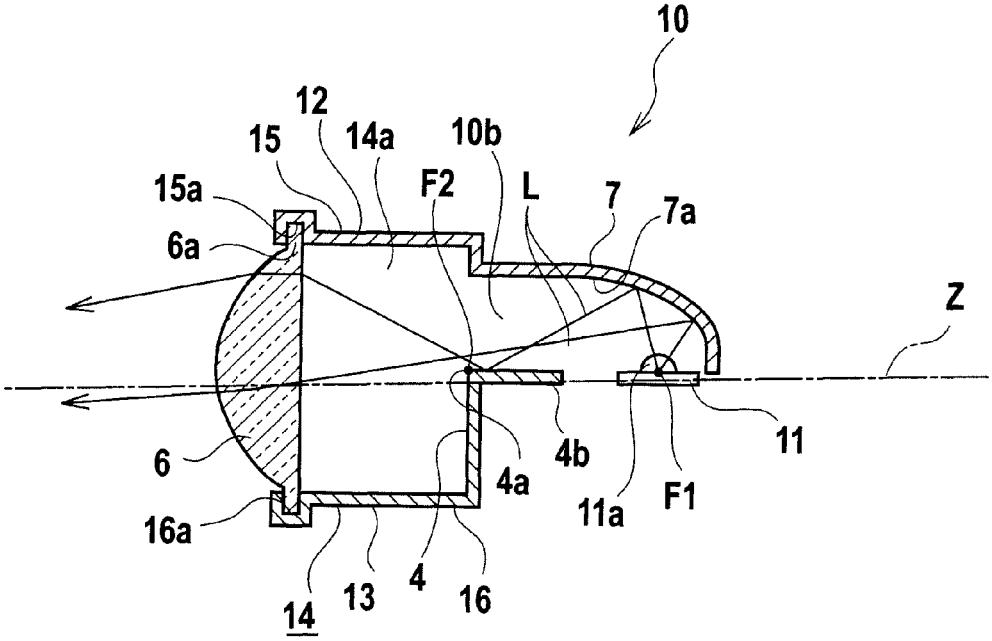
FIG. 7 is a cross section view of the projector type lamp taken along a line VII-VII in FIG. 6.
Figure 8:
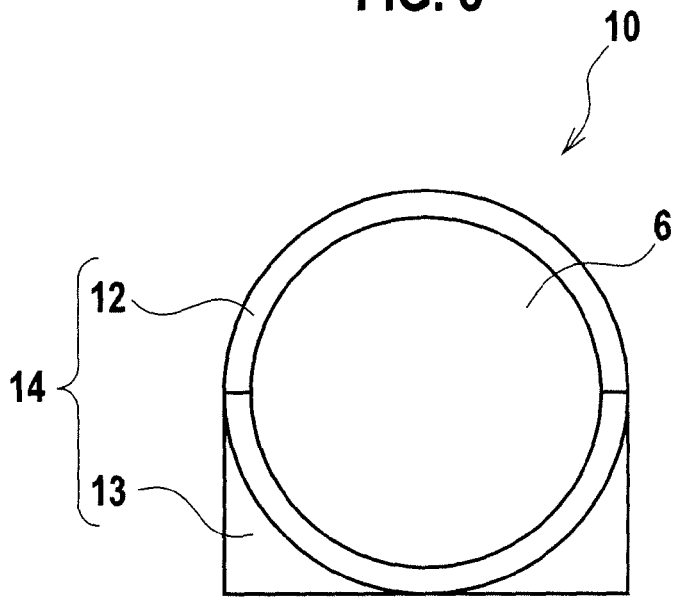
FIG. 8 is a front view of the projector type lamp seen taken along an arrow VIII in FIG. 6.
Figure 9:
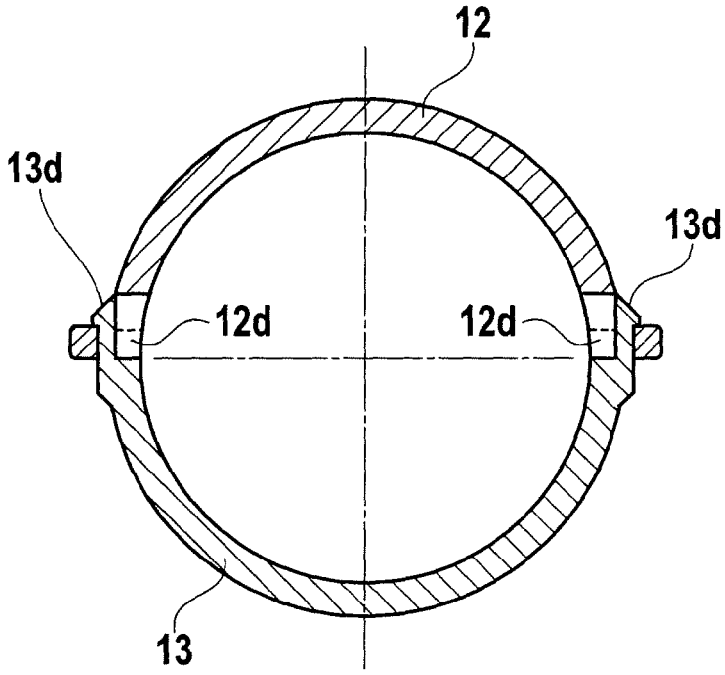
FIG. 9 is a cross sectional view of the projector type lamp taken along a line IX-IX in FIG. 6.

The projector type lamp 10 includes a tubular resin casing 14 formed with an opening at the front end, the resin convex projection lens 6 covering the front open end of the casing 14, and an LED 11 functioning as a light source fixed to the casing 14 via a base plate 9 (See FIGS. 4 and 5).

As shown in FIG. 4, the casing 14 is divided into an upper casing member 12 and a lower casing member 13. In other wards, the casing 14 is formed by the upper casing member 12 and the lower casing member 13.

A front portion of the upper casing member 12 functions as a reflector portion 7 and a back portion functions as an upper holding portion 15.

The upper holding portion 15 is formed in a horizontally extending tubular shape with its lower half cut off. An inside face of the upper holding portion 15 is formed with an upper groove 15*a* at the front end thereof which extends in the circumferential direction.

The reflector portion 7 is formed in a substantially half dome shape and formed with a concave mirror 7*a* on an inside face thereof. The concave mirror 7*a* is formed as a spheroidal surface or a free-curved surface that is base on a spheroidal surface.

A back portion of the lower casing member 13 functions as a shade 4 and a front portion functions as a lower holding portion 16.

The lower holding portion 16 is formed in a horizontally extending tubular shape with its upper half cut off. An inside face of the lower holding portion 16 is formed with a lower groove 16*a* at the front end thereof which extends in the circumferential direction.

The shade 4 of the lower casing member 13 extends from the rear end of the lower holding portion 16 and forms an L-shaped plate in a cross section.

A folded portion 4*a* of the L-shaped shade 4 is disposed at a second focal point F2 of the concave mirror 7*a* and has a scaling relationship with a cut line CL of a projection pattern LP (see FIG. 10), that is, a light distribution pattern of the projector type lamp 10.

The lower casing member 13 and the upper casing member 12 are connected to each other to form the casing 14, so that a cylindrical holding portion (15, 16) is formed at the front portion of the casing 14 and a cylindrical groove (15*a*, 16*a*) is formed at the inside face of the front open end of the holding portion (15, 16).

The convex lens 6 is fixedly supported between the casing members 12, 13 to be held by casing 14 so that a flange 6*a* of the convex lens 6 is inserted and fitted in the cylindrical groove (15*a*, 16*a*) of the casing 14.

The convex lens 6 can be made of transparent thermoplastic resin such as polycarbonate resin or acrylate resin. The casing members 12, 13 forming the casing 14 may be made of light-blocking thermoplastic resin such as polycarbonate resin or acrylate resin. Thermoplastic resin has sufficient strength and is easily formed, so that the convex lens 6 and the casing members 12, 13 can be accurately molded. Preferably, the convex lens 6 is made of acrylate resin that has high-optical property.

The concave mirror 7*a* can be formed as a reflective layer by vapor-depositing, such as a silver reflective layer on the inside face of the upper casing member 12.

The LED 11 as a light source is disposed at a first focal point F1 of the concave mirror 7*a* such that a light emitting portion 11 a of the LED 11 faces the concave mirror 7*a*. An optical axis of the light emitting portion 11*a* is orthogonal to an optical axis Z of the lamp 10, that is, an optical axis Z of the concave mirror 7*a*. The first focal point F1 of the concave mirror 7*a* and the center of the convex lens 6 lie on the optical axis Z of the lamp 10.

A chamber in the casing 14 includes a front chamber 14*a* and a rear chamber 14*b*. The front chamber 14*a* is defined by the convex lens 6 and the upper holding portion 15 and the lower holing portion 16 so as to be in a substantially cylindrical shape. The rear chamber 14*b* is defined by an upper side 4*b* of the shade 4 and the concave mirror 7*a* so as to be in a substantially half dome shape.

As shown in FIG. 4, locating means or pins 13*c* are formed in a flange 13*a* of the lower casing member 13, and locating means or holes 12*a* are formed in a flange 12*a* of the upper casing member 13. The locating pins 13*c* of the lower casing member 13 are inserted and fit in the locating holes 12*d* of the upper casing member 12. With this structure, the lower casing member 13 and the upper casing member 12 are connected.

As shown in FIG. 4, latch claws 13*d* as provisional fixers are formed on a flange 13*a* of the lower casing member 13, and latch holes 12*d* as provisional fixers are formed in a flange 12*a* of the upper casing member 12. The latch claws 13*d* are inserted in and latched with the latch holes 12*d*, so as to provisionally fix the casing members 12, 13 by fitting the flanges 12*a*, 13*a* to each other.

A connecting direction of the provisional fixers 12*d*, 13*d* corresponds to a connecting direction of the casing members 12, 13. Those directions are shown vertically in FIG. 4.

An assembly process of the projector type lamp 10 will be described with reference to FIGS. 4 and 5.

Firstly, the LED 11 is pre-assembled to the base plate 9, as shown in FIG. 5. FIG. 5 shows four lead wires 25, which include two lead wires 25 connected to the LED 11 and two lead wires 25 connected to a thermoelectric cooling element (not shown).

Next, as shown in FIG. 4, the base plate 9 having the LED 1 is fixed to the upper casing member 12 by screws 24 so that the light emitting portion 11*a* of the LED 11 faces the concave mirror 7*a* and is disposed at or around the first focal point F1 of the concave mirror 7*a*.

Next, as shown in FIG. 4, the locating pins 13*c* in the flange 13*a* of the lower casing member 13 are inserted and fit in the locating holes 12*d* in the flange 12*a* of the upper casing member 12, while the latch claws 13*d* in the flange 13*a* of the lower casing member 13 are inserted in and latched with the latch holes 12*d* in the flange 12*a* of the upper casing member 12, so as to provisionally fix the casing members 12, 13 in place by fitting the flanges 12*a*, 13*a* to each other.

When provisionally fixing the casing members 12, 13 to each other, the flange 6*a* of the convex lens 6 is inserted and fit in the cylindrical groove (15*a*, 16*a*) of the casing members 12, 13 such that the casing members 12, 13 hold the convex lens 6 in between.

Next, the flanges 12*a*, 13*a* of the casing members 12, 13 are fastened to each other by the screw 8 as the fastening step, and the assembling of the projector type lamp 10 is completed.

Next, all of the assembled projector type lamps 10 are mounted to the housing body 22 by the mounting brackets 23, and then the outer lens 21 is attached to the front open end of the housing body 22. With this process, the assembling of the head lamp A is completed.

In the respective projector type lamps 10*a* to 10*j* of the headlamp A, the light emitting portion 11*a* of the LED 11 emits light to the concave mirror 7*a*. The light is reflected on the concave mirror 7*a*, converged on the second focal point F2 of the concave mirror 7*a* at or around the edge 4*a* of the shade 4, refracted by the projector lens 6, and then projected forward from the respective project type lamps 10*a* to 10*j*.

Figure 10:
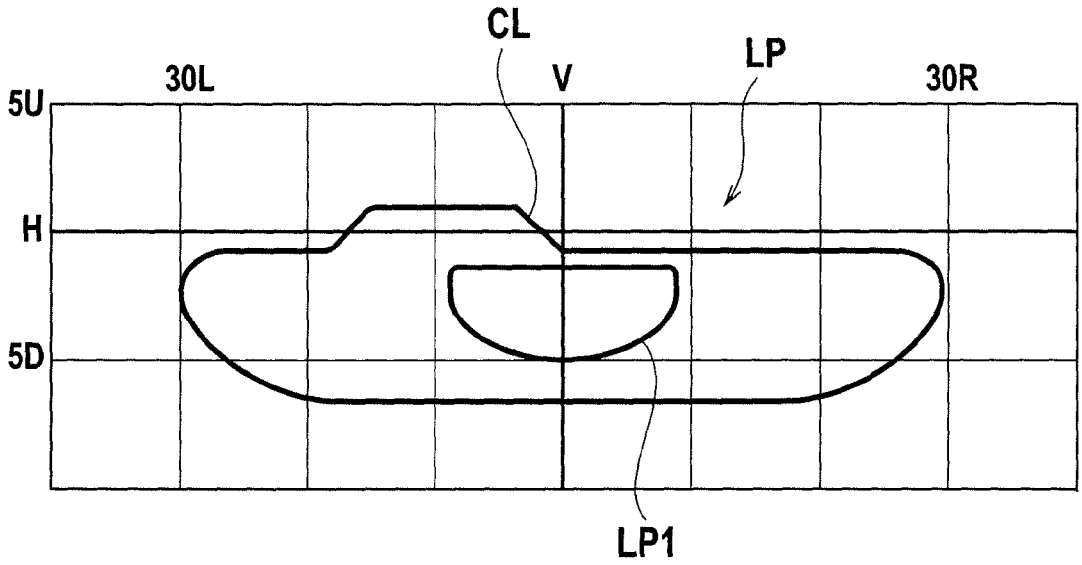
FIG. 10 is a view of a projected pattern of the projector type lamp of the first embodiment.

The projected light is in the form of substantially pencil which has the projection pattern LP with the cut line CL (see FIG. 10).

FIG. 10 shows the projection pattern LP. The projection pattern LP has a high-brightness zone LP1 in a center portion thereof. Also the projection pattern LP includes the cut line CL that corresponds to the edge 4*a* of the shade 4 at an upper horizontal edge thereof, so as to be suitable as a low bean of the vehicular head lamp.

The projector type lamps 10*a* to 10*j* may have different projection patterns depending on mounting positions thereof in the headlamp.

Next, effects of the first embodiment will be explained.

According to the first embodiment, a projector type lamp 10 includes: a casing 14 formed with a front open end that is formed by connecting an upper casing member 12 and a lower casing member 13; a concave mirror 7*a* on an inside face of the casing 14 and having a surface formed as an ellipsoid of revolution or an elliptic free-curved surface; a light source 11 provided at or around the first focal point F1 of the concave mirror 7*a*; a convex lens 6 configured to be held between the upper casing member 12 and the lower casing member 13 at the front open end of the casing 14 and adapted to refract a reflected light that is emitted from the light source 11 and reflected on the concave mirror 7*a* so as to project a substantially parallel pencil beam forward from the project type lamp 10; provisional fixers 12*d*, 13*d* formed at the upper casing member 12 and the lower casing member 13 respectively and configured to latch one another so as to provisionally fix the casing members 12, 13 one another; and a fastening 8 configured to fasten the provisionally-fixed casing members 12, 13 together.

With this configuration, the casing members 12, 13 can be provisionally fixed to each other by the provisional fixers 12*d*, 13*d* thereof, prior to fastening of the casing members 12, 13 by the fastener 8. This makes the fastening operation of the casing members 12, 13 easy and improves operability of the projector type lamp 10 in assembly operations.

According to the projector type lamps 10*a* to 10*j* of the first embodiment, the provisional fixers 12*d*, 13*d* are a latch claw 13*d* and a latch hole 12*d* respectively. This simplifies the structures of the provisional fixers 12*d*, 13*d* and suppresses an increase of production cost.

According to the projector type lamp 10 of the first embodiment, a connecting direction of the provisional fixers 12*d*, 13*d* corresponds to a connecting direction of the casing members 12, 13.

With this structure, when connecting the casing members 12, 13 to each other, the provisional fixers 12*d*, 13*d* are also latched with each other. This improves the operability of the projector type lamp 10 in assembly operations.

Second Embodiment

Figure 11:
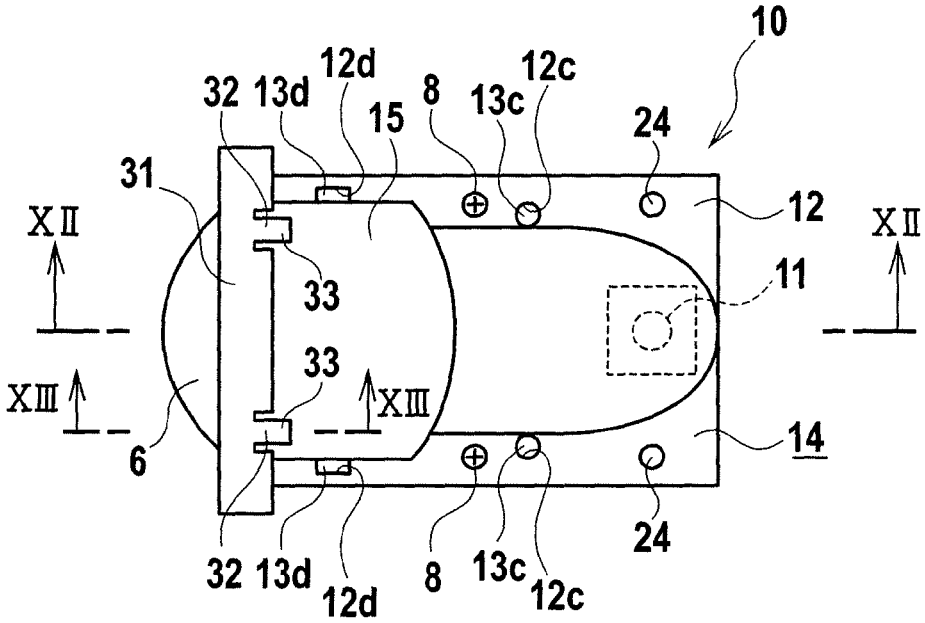
FIG. 11 is a plane view of a projector type lamp of a second embodiment according to the present invention.
Figure 12:
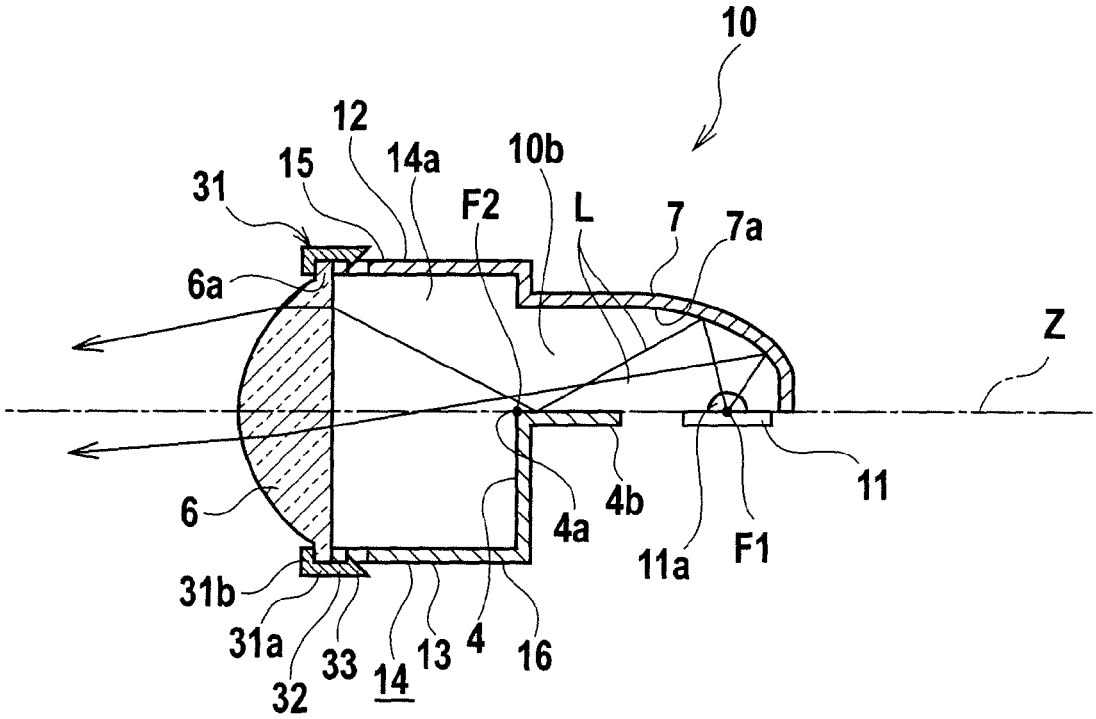
FIG. 12 is a sectional view of the projector type lamp taken along a line XII-XII in FIG. 11.
Figure 13:
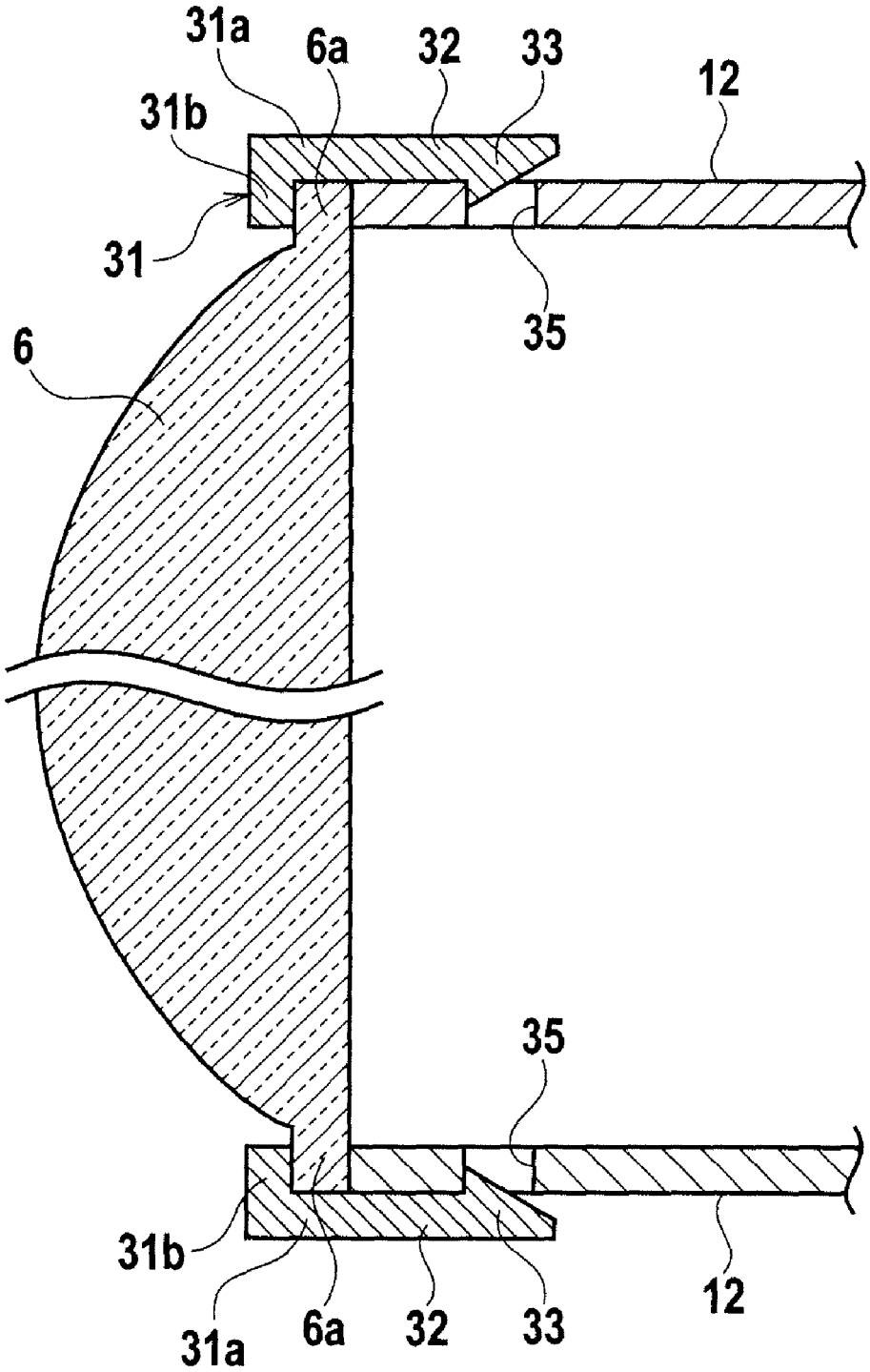
FIG. 13 is a sectional view of the projector type lamp taken along a line XIII-XIII in FIG. 11.

Next, a second embodiment according to the present invention will be explained. FIGS. 11 to 13 show a projector type lamp 10 of the second embodiment. Components identical to those in the first embodiment are given the same reference numerals in the second embodiment, and their configurations, functions and effects are omitted here.

The projector type lamp 10 of the second embodiment does not include the cylindrical groove (15*a*, 16*a*) at the inside face of the front open end of the casing 14. Instead, a ring member 31 is provided to prevent the casing members 12, 13 from disassembling or separating from each other.

As shown in FIGS. 11 to 13, the ring member 13 is formed in a substantially cylindrical ring shape and fitted around the outside face of the casing 14 at the front end, so as to prevent the casing members 12, 13 from disassembling , i.e., separating from each other.

A connecting direction of the ring member 31 to the front end of the casing corresponds to the optical axis Z of the projector type lamp 10. In other words, the connecting direction of the ring member 31 and the connecting direction of the casing members 12, 13 (the connecting direction of the provisional fixers 12*d*, 13*d*) are cross (perpendicular) to one another, that is, not parallel to one another. In the second embodiment, the connecting directions are at right angle to each other.

The ring member 31 is formed with a recess that opens toward the rear side and receives the flange 6 of the convex lens 6 and the front end of the casing 14 therein. In other wards, the ring member 31 is formed integrally with a cylindrical tubular portion 31*a* that has an inside face formed along the outside face of the flange 6*a* of the convex lens 6, and a flat plate portion 31*b* that extends from the front end of the tubular portion 31*a* toward an inner side of the tubular portion 31*a*.

The flange 6*a* of the convex lens 6 is received in the tubular portion 31*a* of the ring 31, and the flange 6*a* is sandwiched between the rear end face of the flat portion 31*b* of the ring member 31 and the front end face of the casing 14.

The ring member 31 is formed integrally with locking parts 33 that are adopted to latch with locking parts 35 that are formed at the upper casing member 12 and the lower casing member 13, respectively.

The locking parts 33, 35 are configured to maintain the connection of the ring member 31 to the casing 14, that is to say, to prevent detachment of the ring member 31 from the casing 14.

In this second embodiment, each of the locking parts 33 of the ring member 31 is formed as a latch claw 33 and each of the locking parts 35 of the casing members 12, 13 is formed as a latch hole 35 that catches the latch claw 33.

The latch claws 33 are formed at a rear end of an elastic arm 32 that project from the tubular portion 32.

In addition to the effects of the first embodiment, the second embodiment provides effects as described below.

According to the second embodiment, the projector type lamp 10 further includes the ring member 31 configured to fit around the front end of the casing 14 so as to enclose and tighten the casing members 12, 13. With this structure, the ring member 31 firmly tightens the front end of the provisionally fixed casing members 12, 13, together so that the fastening operation of the screw 8 becomes easier.

According to the second embodiment, the ring member 31 and the casing 14 are formed with locking parts 33, 35 respectively that latch each other. With this configuration, the ring member 31 does not fall off the casing 14, so that the fastening operation of the screw 8 becomes much easier.

According to the second embodiment, the connection direction of the ring member 31 to the casing 14 is the same as the connection direction of the locking parts 33, 35. With this structure, when the ring member 31 and the casing 14 are connected to each other, the locking parts 33, 35 are connected so as to be latched with each other. Therefore, the projector type lamp 10 provides improved efficiency in the assembling operations.

As described above, the present invention provides a projector type lamp with an improved assembly efficiency.

Although the present invention has been described above by reference to certain embodiments, the present invention is not limited to these embodiments. Modifications and variations of the embodiments can be made without departing from the spirit or scope of the appended claims. The embodiments are only for illustrative purposes and are not intended to limit the present invention.

What is claimed is:

1. A projector type lamp comprising;

a casing having a front open end and configured by connecting an upper casing member and a lower casing member to each other;

a concave mirror formed on an inside face of the casing;

a light source provided at a first focal point of the concave mirror;

a convex lens configured to be held between the upper casing member and the lower casing member at the front open end of the casing and adapted to refract a reflected light that is emitted from the light source and reflected on the concave mirror so as to project substantially parallel pencil beam forward from the project type lamp;

positioning portions provided in the upper casing member and the lower casing member respectively and adapted to determine an interposition when coupling the upper casing member and the lower casing member together;

provisional fixers provided on the upper casing member and the lower casing member respectively and configured to latch one another so as to provisionally fix the casing members to one another, coupling positions thereof being determined by the positioning portions; and a fastener configured to fasten the provisionally fixed casing members together, wherein the provisional fixers are arranged closer to the convex lens side than the positioning portions provided in the upper casing member and the lower casing member respectively in order to provisionally fix the upper casing member and the lower casing member for holding the convex lens at the front open end of the casing;

the casing is provided with a chamber, the chamber including:

a front chamber arranged at the front open end of the casing for holding the convex lens, at a front side of the projector type lamp; and a rear chamber arranged closer to a rear side of the projector type lamp than the front chamber;

the positioning portions serve as a first latch portion which is configured to latch a side of the rear chamber of each of the casing members, each of the positioning portions having a locating pin and a locating hole arranged at the side of the rear chamber of each of the casing members, the locating pin being inserted in and fitted in the locating hole; and the provisional fixers serve as a second latch portion which is different from the first latch portion and is configured to latch a side of the front chamber of each of the casing members in order to prevent the convex lens held at the front open end from falling off each of the casing members, each of the provisional fixers having a latch claw and a latch hole arranged at the side of the front chamber of each of the casing members, the latch claw being inserted in and latched with the latch hole, and the projector type lamp is one of a plurality of the projector type lamps, each configured to be incorporated into a single housing for a vehicular lamp.

2. The projector type lamp according to claim 1, wherein a connecting direction of the provisional fixers is the same as a connecting direction of the casing members.

3. The projector type lamp according to claim 1, further comprising a ring member configured to be fitted around the front end of the casing so as to encircle the casing members.

4. The projector type lamp according to claim 3, wherein the casing and the ring member are provided, respectively, with locking parts, the locking part of the casing and the locking part of the ring member being configured to latch one another to prevent detachment of the ring member from the casing.

5. The projector type lamp according to claim 4, wherein a connecting direction of the ring member to the casing is the same as a connecting direction of the locking parts.

* * * * *